United States Patent [19]

Santucci et al.

[11] 4,009,845

[45] Mar. 1, 1977

[54] UNREEL REINFORCER FOR DISPENSING WIRE

[76] Inventors: Kenneth E. Santucci, 526 North Edgewood, LaGrange, Ill. 60185; Donald G. Santucci, 1685 Shelly Lane, Wheaton, Ill. 60187

[22] Filed: Sept. 24, 1975

[21] Appl. No.: 616,293

[52] U.S. Cl. ..... 242/129.7; 242/137.1

[51] Int. Cl.[2] ..... B65H 49/00

[58] Field of Search ..... 242/129, 129.7, 129.71, 242/129.72, 137, 137.1, 138, 163; 206/389–394, 397, 408, 409; 285/319; 403/109, 106, 189, 377; 222/523, 518, 569, 573; 57/106

[56] References Cited

UNITED STATES PATENTS

| | | | |
|---|---|---|---|
| 1,558,561 | 10/1925 | Mossberg | 242/129.7 |
| 2,152,426 | 3/1939 | Wilson | 242/55.2 |
| 3,823,894 | 7/1974 | Frederick et al. | 242/137.1 |
| 3,837,690 | 9/1974 | Fraser, Jr. et al. | 285/319 |
| 3,924,395 | 12/1975 | Grossi | 57/106 |

FOREIGN PATENTS OR APPLICATIONS

| | | | |
|---|---|---|---|
| 91,456 | 12/1961 | Denmark | 242/163 |

*Primary Examiner*—Leonard D. Christian
*Attorney, Agent, or Firm*—Robert L. Lindgren; Davis Chin

[57] ABSTRACT

A package reinforcement and support structure for use in dispensing a winding of flexible material such as wire, cable, rope and the like comprises a first tubular member, a second tubular member telescoped over the first tubular member, and co-operative interlocking elements on the tubular members. The interlocking elements include a pair of first slots formed in a diametrically opposed relationship on the body of the telescoping tubular member and a pair of tang members formed in diametrically opposed relationship on the body of the first tubular member. The tang members are engageable with elements of the first slots for establishing a separable mechanical connection of the first and second tubular members. The cooperative interlocking elements of the support structure also include container or box reinforcements.

14 Claims, 8 Drawing Figures

Fig. 1
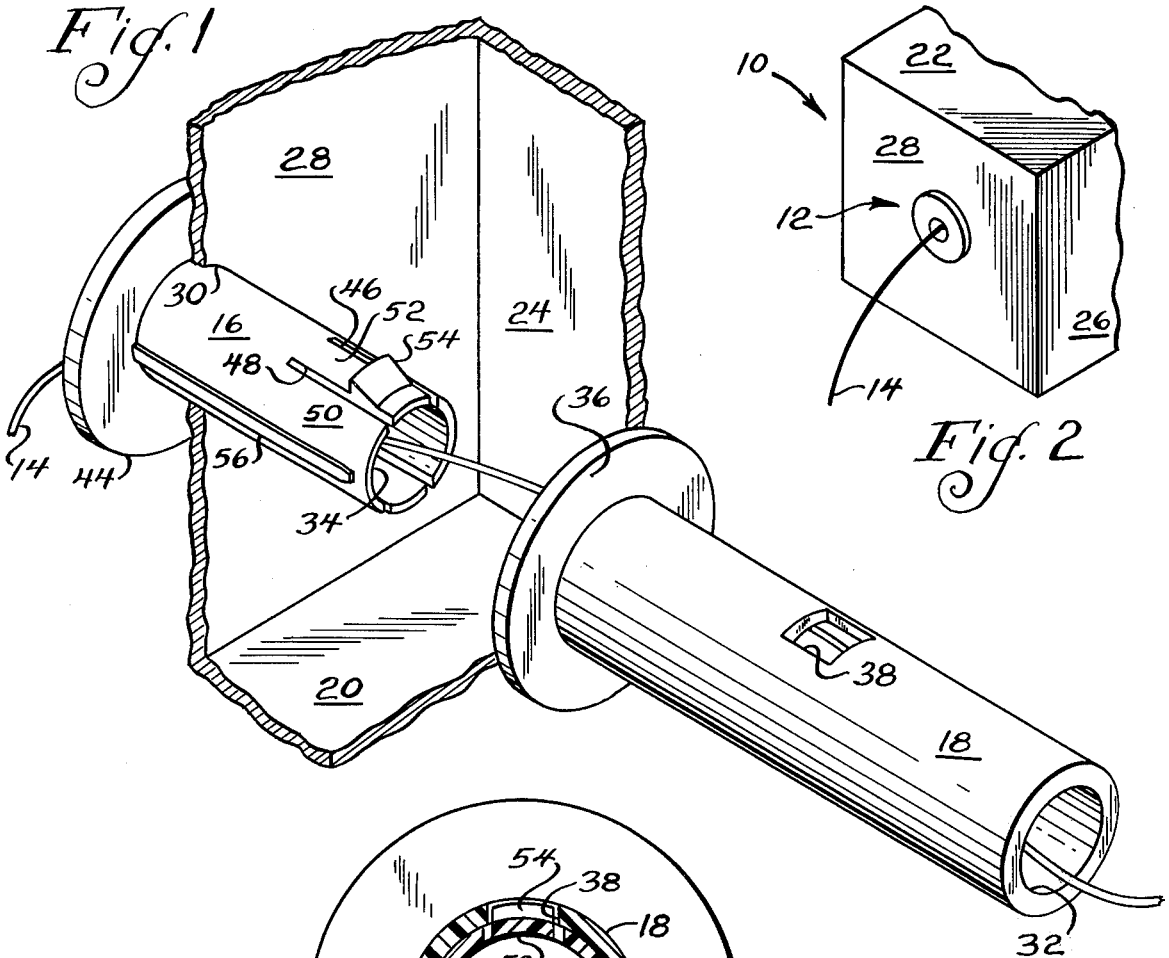
Fig. 2
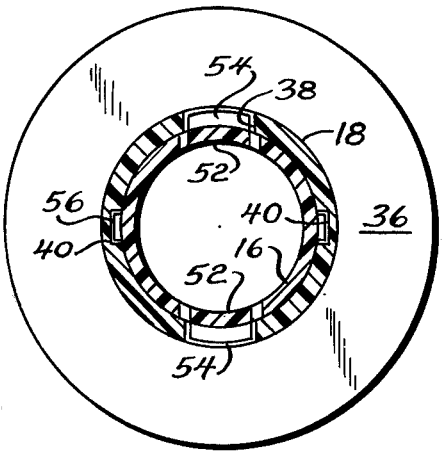
Fig. 4
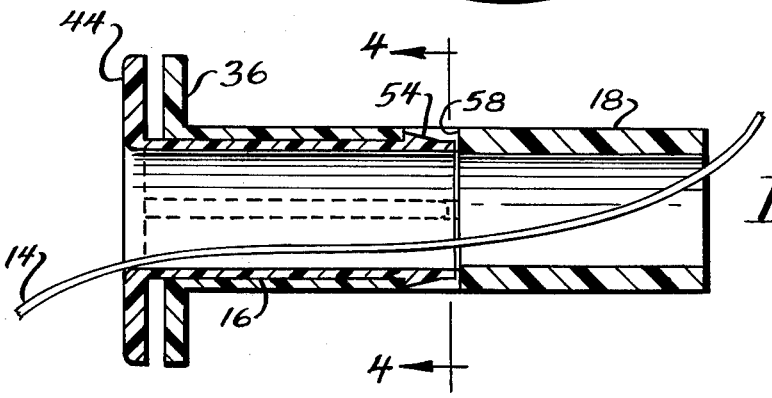
Fig. 3

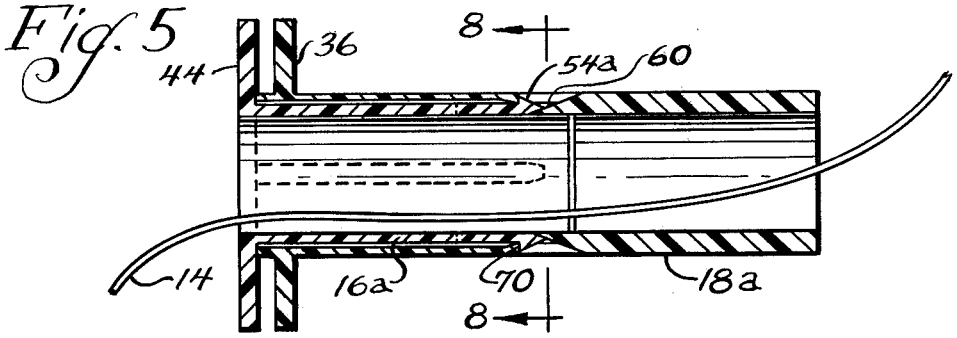
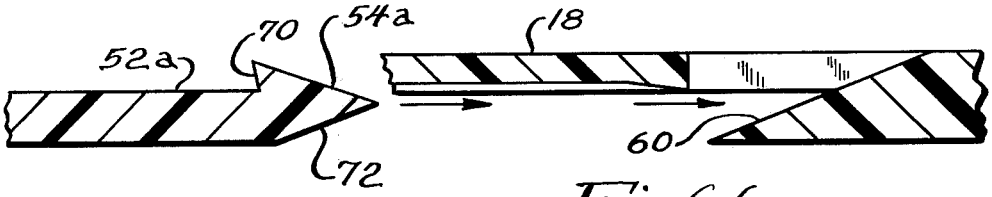
Fig. 6
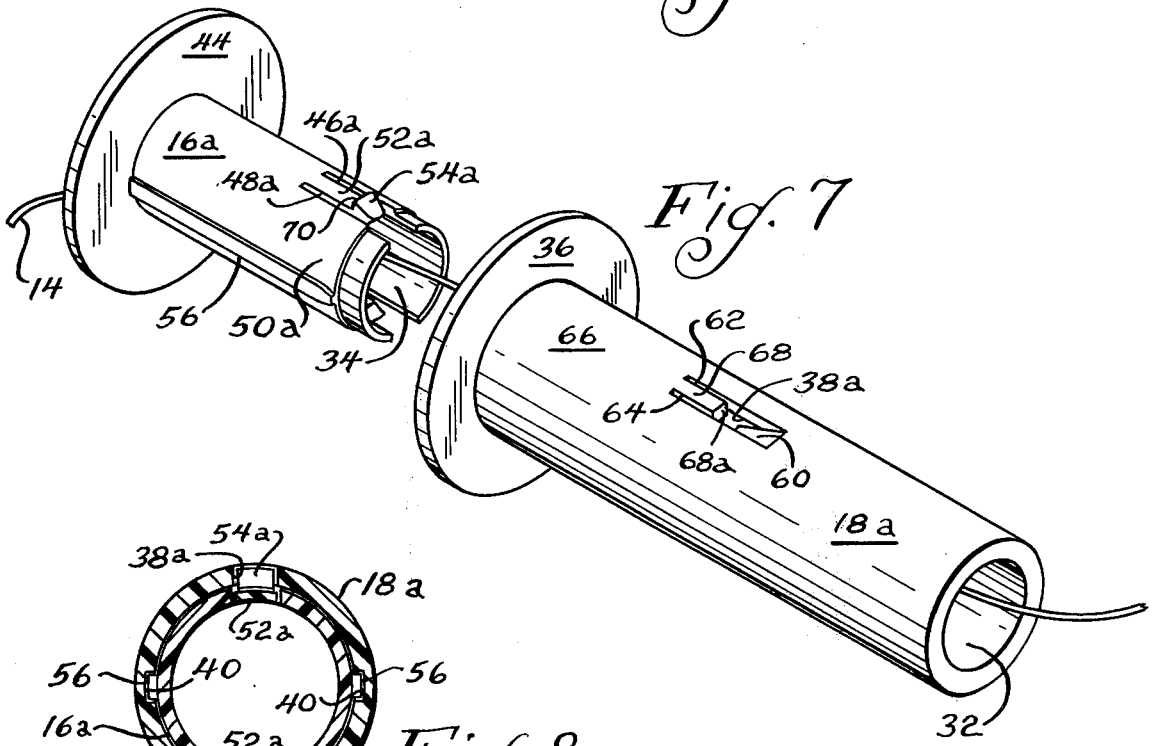
Fig. 7
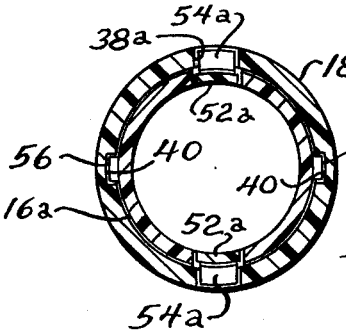
Fig. 8

UNREEL REINFORCER FOR DISPENSING WIRE

BACKGROUND OF THE INVENTION

This invention relates generally to apparatus for dispensing packaged flexible wire, cable, rope and the like. More particularly, the invention relates to a reinforced packaged unreeling system facilitating the storage, handling and dispensing of the material therefrom and the support of the material during all phases of use.

The device of the present invention is ordinarily utilized in conjunction with a packaged winding of flexible material, such as wire, which is wound in a manner permitting the flexible material to be unwound through a radial opening provided in the central, material supporting core thereof. The innermost free end of the material can thereby be drawn out or unwound through the core without twisting, snarling, and kinking of the material.

Variations of internal core-type unwinding method of flexible material are disclosed in U.S. Pat. Nos. 3,666,200; 3,677,491; 3,178,130; and 3,689,005 which show unwinding variations. Reference is made to these patents for explanatory and descriptive purposes relative to known internal winding techniques.

While numerous flexible wound materials such as wire, cable, filaments, rope, etc. can utilize the invention, wire shall be referred to hereinafter for descriptive purposes as an embodiment hereof. Packaged wire windings are commonly contained in cardboard containers or boxes to facilitate storage, handling and shipment. Frequently, a side of such a cardboard container is constructed with a central opening permitting the innermost free wire end to be withdrawn or unwound from the container without opening the container. It has been found, however, that during the wire unwinding or dispensing process the container, and particularly the area around the central opening of the cardboard container or box, is deformed or damaged due to the bending, rubbing and abrading action of the wire against the container or box edge defining the central withdrawal opening as the wire is pulled under relatively high tension from the container. Frequently, container damage is so severe that it may be completely destroyed or rendered useless before all of the wire can be dispensed.

SUMMARY OF THE INVENTION

It is an object of the present invention to provide a container reinforcement for a packaged internal wire dispensing system to protect the dispensing area from damage during shipment and storage, and which permits complete wire unwinding without package damage.

It is an object of the present invention to provide an unreeling system which reinforces or structurally supports the system container at the opening through which the wire is withdrawn or dispensed from the container to prevent damage to the container during dispensation or withdrawal, and to reduce potential damage to the container during shipment and storage.

It is a companion object of the present invention to provide a telescoping support structure including co-operative means for interlocking the elements thereof.

It is an object of the present invention to provide a material support structure with means for automatically aligning co-operative integrally formed interlocking elements thereof.

In accordance with these aims and objectives, the present invention deals with the provision of a container or package reinforcement used in dispensing a pre-wound flexible material, such as wire, comprising a first tubular member, a second tubular member telescoped over the first tubular member, and integrally formed co-operative means formed on the respective members for interlocking the tubular members. The interlock includes a pair of first slots formed in a diametrically opposed relationship on the body of the telescoping tubular member and a pair of tang members formed in diametrically opposed relationship on the body of the first tubular member. The tangs are constructed to engage elements bordering the first slots to establish a separable mechanical connection of the first and second members. Adjacent ends of the telescoping tubular elements are provided with container or box reinforcements.

The system also includes structure for automatic alignment of the tangs on the first tubular member to the first slots on the other tubular member. The alignment structure includes a pair of keying slots disposed in a diametrically opposed relationship on the telescoping tubular member and a pair of outwardly extending tabs disposed in a diametrically opposed relationship on the other tubular member. The tabs cooperatively engage with the keying slots to automatically align the tangs on the first tubular member in proper relationship to the first slot on the second tubular member.

BRIEF DESCRIPTION OF THE DRAWINGS

The above and other objects and advantages of the present invention will become more apparent from the foregoing description when read in conjunction with the accompanying drawings; wherein:

FIG. 1 shows an enlarged and exploded perspective view of the support and container reinforcement constructed according to the present invention;

FIG. 2 shows a partial perspective view of a container or box embodying the present invention;

FIG. 3 is a sectional view of the support structure of the present invention;

FIG. 4 is a cross-sectional view taken along the line 4—4 of FIG. 3;

FIG. 5 is a sectional view of a second embodiment of the support structure of the invention;

FIG. 6 is an enlarged sectional detailed view of the locking tang and slot in the second embodiment;

FIG. 7 is an enlarged exploded perspective view of the second embodiment of the invention; and FIG. 8 is a cross-sectional view taken along the line 6—6 of FIG. 5.

DETAILED DESCRIPTION OF THE PREFERRED EMBODIMENTS

The present invention has numerous applications in other forms of apparatus since the invention both pertains to a reinforcement and support device and to a material support structure having a first tubular member, a second tubular member telescoped over the first tubular member and interlocking elements on the tubular members, the interlocking elements including reinforcing members.

Referring now in detail to the drawings, FIG. 2 illustrates a shipping and/or dispensing container or box 10 made preferably of cardboard and houses a wire dispenser and support 12 of the present invention along with a winding of flexible material (not shown), such as wire, cable, rope and the like of any cross-section formed, for instance in the manner shown in any one of the earlier-mentioned patents. Such windings are usually wound in a manner to permit the flexible material to be unwound through a radial opening provided in a central material supporting core thereof. A free inner end 14 of the winding is led out or withdrawn through this radial opening.

The wire dispenser and support 12 for dispensing wire and the like comprises two tubular members 16 and 18. The inner tubular member 16 is telescoped or inserted into the outer tubular member 18, the operation and structure thereof will be more fully explained in greater detail hereinafter. The wire dispenser and support not only give structural support to the winding of the material in the container 10 during handling and shipment, but also provide a means for guiding the free end 14 of the wire as it is withdrawn from its inner wall of the winding and thus prevents snarling or entanglement thereof during dispensing.

FIG. 1 illustrates the shipping and/or dispensing container 10 for housing the wire dispenser and support 12 for dispensing wire. The container is depicted in part with a bottom wall 20 (FIG. 1) and a top wall 22 (FIG. 2). An end wall 28 has a central opening or aperture 30 therein. The walls 20 and 22 are interconnected by side walls 24 and 26. The free inner end 14 of the winding is fed through opening 32 in the outer tubular member 18, opening 34 in the inner tubular member 16, and the opening 30 in the end wall 28.

Referring to the embodiment shown in FIGS. 1, 3 and 4, the outer tubular member is made of a resilient material such as plastic and has an integrally formed annular flange 36 defining a reinforcement element disposed around its one end. A pair of first slots 38 are formed in diametrically opposed relationship in substantially the mid-section of the outer tubular member. However, it is to be understood that the first slots may be provided anywhere along the length of the outer tubular member in other applications. A pair of grooves or keying slots run lengthwise along an inner surface in a first section 42 of the outer tubular member. The grooves or keying slots 40 are disposed diametrically opposite each other and perpendicularly to the first slot 38.

The inner tubular member 16 is also made of a resilient material, preferably of plastic, and has an integrally formed annular flange 44 defining a second reinforcement element disposed around its one end. Slits 46 and 48 are formed on a first section 50 of the inner tubular member. The slits 46 and 48 define integrally formed locking tangs or fingers 52 disposed therebetween. Each of the pair of tangs 52 is provided with a raised and sloping portion 54 on its one end. The tangs 52 are disposed in diametrically opposed relationship and are capable of being flexed inwardly to enter the inside of the outer tubular member. On the outer surface of the inner tubular member in a radial plane perpendicular to the tangs 52, a pair of integrally formed and outwardly extending projections or tabs 56 are provided which run lengthwise and terminate a short distance from the opening 34.

In using the wire dispenser and support, the outer tubular member 18 is assembled to the winding (not shown) of flexible material with the free end 14 thereof extending out of the end of the outer tubular member 18 near the annular flange 36. Then, the assembled outer tubular member and winding is placed in the container 10 with the annular flange 36 arranged adjacent the opening 30 in the end wall 28. The inner tubular member is inserted into the opening 30 and into the inside of the outer tubular member with the free end of the wire extending through the opening 34 in the inner tubular member and out the opening 30 in the container as shown in FIG. 1.

During the insertion of the inner tubular member 16 into the outer tubular member 18, the tabs 56 cooperatively engage into the grooves or keying slots 40, and the tangs 52 flex inwardly to allow the mating of the tubular members. The keying slots 40 provide for rotational stability and serve as a means for automatic alignment of the tangs 52 in the inner tubular member in proper relationship to the first slots 38 in the outer tubular member. A shoulder 58 formed adjacent the first slots 38 serves to stop the ingress of the inner tubular member into the outer tubular member. The raised and sloping portions 54 of the tangs 52 snap into the first slots 38 to affixedly engage for establishing a separable mechanical connection of inner and outer tubular members, the tangs and first slots defining interlocking means.

In the locking engagement of the tubular members, the annular flange 44 of the inner tubular member 16 and the annular flange 36 of the outer tubular member 18 closely and firmly abut the inside and outside surfaces respectively of the container end wall 28 bordering the opening 30. The integrally formed flanges thereby serve as the first and second reinforcement elements to reinforce or structurally support the container in the area adjacent to the wire dispensing opening to prevent damage to the container during dispensing of wire therefrom. Further, the wire dispenser supports the winding of the wire during its use and also guides the same during withdrawal.

The tubular members can be disengaged by depressing the integrally formed tangs 52 to clear the slots 38 and pulling the inner tubular member 16 away from the outer tubular member 18.

In FIGS. 5 through 8, a second embodiment is shown of the wire dispenser and support. It can be seen in this embodiment that the integrally formed tangs **52*a* will become permanently locked in the slots 38*a* once the inner tubular member is telescoped or inserted into the outer tubular member. As best seen in FIGS. 6 and 7, the outer tubular member 18*a* is formed with a pair of first slots 38*a* (FIG. 5) having a downwardly sloping portion 60. Slits 62 and 64 are formed on a first section 66 of the outer tubular member 18*a*. Tangs or fingers 68 are formed between the slits 62 and 64 and are provided with an extending portion 68*a*. The inner tubular member 16*a* is formed with slits 46*a* and 48*a* on a first section 50*a* thereof. Between the slits 46*a* and 48*a*, there is defined locking tangs or fingers 52*a*. The tangs 52*a* have a raised and sloping portion 54*a* having a first edge 70 and a second edge 72. The edge 72 of the tang 52*a* cooperatively engages with the sloping portion 60 of the slots 38*a* and the edge 70 cooperatively engages with the extending portion 68*a* of the tang 68** to permanently lock the tubular members together. Otherwise, the operation is exactly the same as the first embodiment.

While this invention has particular application to wire dispensing, the tubular elements of the telescoping support structure, without reinforcement flanges, can be connected respectively to any form of structural module. In such applications, the inner tubular member can be affixed to a first module (not shown) and the outer tubular member can be affixed to a second module (not shown). The modules can then be separably or inseparably joined in locking engagement as described above.

From the foregoing description of the wire dispenser and support for dispensing wire embodying the present invention, it can be seen that an improved unreeling system is provided which reinforces or structurally supports the system container in an area adjacent the dispensing opening through which the wire is withdrawn from the container to prevent damage thereto during dispensation or withdrawal. Further, the wire dispenser and support is provided with means for automatically aligning interlocking elements thereof.

While a preferred embodiment of the present invention has been illustrated and described, it will be understood by those skilled in the art that various changes and modifications may be made and equivalents may be substituted for elements hereof without departing from the true scope of the invention. In addition, many modifications may be made to adapt a particular situation or material to the teachings of the invention without departing from the central scope thereof. Therefore, it is intended that this invention not be limited to the particular embodiment disclosed as a best mode contemplated for carrying out this invention, but that the invention will include all embodiments falling within the scope of the appended claims.

What is claimed is:

1. A support for use in winding and dispensing a winding of flexible material comprising;

a first tubular member;

a second tubular member telescoped over the first tubular member;

means for interlocking said tubular members; and said interlocking means comprising a pair of first slots formed in a diametrically opposed relationship on said second tubular member and a pair of tangs formed in a diametrically opposed relationship on said first tubular member, said tangs being separably engageable with the first slots for interlocking connection.

2. A support as claimed in claim 1, further comprising means for automatic alignment of said tangs on said first tubular member to said first slots on said second tubular member.

3. A support as claimed in claim 2, wherein said alignment means comprise a pair of keying slots disposed in a diametrically opposed relationship on one tubular member and a pair of outwardly extending tabs disposed in a diametrically opposed relationship on the other of said tubular members, said tabs cooperatively engaging into said keying slots to automatically align the tangs on said first tubular member in proper relationship to said slots in said second tubular member.

4. A support as claimed in claim 3, wherein said keying slots are disposed perpendicularly to said first slots and wherein said tabs are disposed perpendicularly to said tangs.

5. A support as claimed in claim 1, wherein said second tubular member has a first reinforcement element disposed around its one end and said first tubular member has a second reinforcement element disposed around its one end, said first and said second reinforcement elements being adapted structurally supporting a container at the area adjacent to an opening through which the winding of flexible material is dispensed therefrom.

6. A support as claimed in claim 5, wherein said first and second reinforcement elements comprise an annular flange.

7. A support for use in winding and dispensing a winding of flexible material comprising:

a first tubular member having a reinforcement element disposed around its one end;

a second tubular member having another reinforcement element disposed around its one end;

said reinforcement elements being adapted to be abutted against the inside and outside surfaces of a container to structurally support the container at the area adjacent to an opening through which the winding of flexible material is dispensed therefrom when the second tubular member is telescoped over the first tubular member; and means for maintaining said tubular member in telescoped relationship.

8. A support as claimed in claim 7, wherein each of said reinforcement elements comprises an annular integrally formed flange.

9. A support as claimed in claim 7, wherein said maintaining means comprise a pair of first slots formed in a diametrically opposed relationship on said second tubular member and a pair of tangs formed in a diametrically opposed relationship on said first tubular member, said tangs being separably engageable with the first slots for interlocking telescoping connection.

10. A support as claimed in claim 9, further comprising means for automatic alignment of said tangs on said first tubular member to said first slots on said second tubular member to facilitate interlocking engagement and disengagement.

11. A support as claimed in claim 10, wherein said alignment means comprise a pair of keying slots disposed in a diametrically opposed relationship on one tubular member and a pair of outwardly extending tabs disposed in a diametrically opposed relationship on the other of said tubular members, said tabs cooperatively engaging into said keying slots to automatically align the tangs on said first tubular member in proper relationship to said slots in said second tubular member.

12. A support as claimed in claim 11, wherein said keying slots are disposed perpendicularly to said first slots and wherein said tabs are disposed perpendicularly to said tangs.

13. A material support structure comprising:

a first tubular member having a pair of tangs formed in a diametrically opposed relationship;

a second tubular member having a pair of first slots formed in a diametrically opposed relationship;

said second member being telescoped over said first member;

said tangs being separably engageable into said first slots for interlocking connection when said members are telescoped;

means for automatic alignment of said tangs on said first member to said first slots on said second member; and said alignment means comprising a pair of keying slots disposed in a diametrically opposed relationship on one of said tubular members and a pair of outwardly extending tabs disposed in a diametrically opposed relationship on other of said tubular members, said tabs cooperatively engaging into said keying slots to automatically align said tangs in the second member in proper relationship to said first slot on the first member.

14. An apparatus as claimed in claim 13, wherein said keying slots are disposed perpendicularly to said first slots, and wherein said tabs are disposed perpendicularly to said tangs.

* * * * *